United States Patent [19]

Balzarotti

[11] Patent Number: 4,747,549

[45] Date of Patent: May 31, 1988

[54] ACCUMULATING DEVICE FOR WEFT YARN FEEDERS TO TEXTILE MACHINES

[75] Inventor: Marco Balzarotti, Olgiate Olona, Italy

[73] Assignee: Sarfati & Vischiani S.p.A., Italy

[21] Appl. No.: 3,320

[22] Filed: Jan. 14, 1987

[30] Foreign Application Priority Data

Apr. 30, 1986 [IT] Italy ..... 20280 A/86

[51] Int. Cl.[4] ..... B65H 51/20

[52] U.S. Cl. ..... 242/47.12; 242/47.01; 242/47.05

[58] Field of Search ..... 242/47.12, 47.13, 47.01, 242/47.04, 47.05, 47.06, 47.07; 139/452; 66/132 R, 132 T

[56] References Cited

U.S. PATENT DOCUMENTS

| | | | |
|---|---|---|---|
| 3,776,480 | 12/1973 | Lawson | 242/47.12 X |
| 3,971,522 | 7/1976 | Pfarrwaller | 242/47.01 |
| 4,037,802 | 7/1977 | Calamani | 242/47.05 |
| 4,044,962 | 8/1977 | Calamani et al. | 242/47.05 |
| 4,090,677 | 5/1978 | Savio et al. | 242/47.01 |
| 4,403,745 | 9/1983 | Tholander | 242/47.01 |
| 4,632,154 | 12/1986 | Maina | 242/47.01 X |

*Primary Examiner*—Stanley N. Gilreath

*Attorney, Agent, or Firm*—Lerner, David, Littenberg, Krumholz & Mentlik

[57] ABSTRACT

The invention relates to an accumulating device for weft yarn feeders to textile machines, capable of positioning windings of weft yarns onto a fixed winding drum and of advancing them by keeping the same spaced between each other. It essentially comprises a series of non rotating fingers housed in suitable openings of the drum peripheral skirt, which partially and variably protrude from said skirt as a consequence of the motor shaft movement forming said windings and to which said fingers are coupled through a bearing and a rotary eccentric bush. In order to allow to vary at will the step between said windings, the bush is mounted on said shaft with the interposition of a ball joint so that its inclination with respect to the shaft axis can be adjusted at will.

6 Claims, 2 Drawing Sheets

1
4
5
6
7
8
9
10
11
12
13
14
15
16
17
18
19
20
22
23
24
25
26
28
29
30
31

ACCUMULATING DEVICE FOR WEFT YARN FEEDERS TO TEXTILE MACHINES

BACKGROUND OF THE INVENTION

1. Field of the Invention

The present invention relates to an accumulating device for weft yarn feeders to textile machines, of the type comprising a fixed winding drum receiving windings of weft yarns, whose perpheral skirt is interrupted by openings housing so-called fingers or columns, essentially positioned parallel to the drum axis and actuated to swing in order to partially and variably project from said openings and cause said windings to advance on the drum keeping them spaced between each other. The columns, in sequence, radially move and longitudinally swing with respect to the drum due to the fact that they are connected to the feeder motor shaft through a series of coupling means.

2. Description of the Prior Art

As it is known, modern looms ensure constant operating cycles and regular sequence of the different manufacturing steps for every type of yarn. For these reasons the socalled shuttleless looms must be provided with weft feeders, in which the yarn is taken from a reel, is laid down in subsequent and parallel windings on a fixed drum and finally is taken from the latter in an axial direction to be fed to the loom, always ensuring, besides speed, also a constant tension to avoid sudden jerks which would cause process interruptions.

It is therefore necessary, for a regular manufacturing cycle, to always ensure a constant reserve of yarn on the drum.

Moreover it is sometimes necessary, for particular yarns, to warrant that said reserve be formed on the drum also by keeping a predetermined distance or step between each winding and the following one.

In order to comply with said requirement, various solutions have been proposed up to now. Among the most significant solutions we can mention the one of using so-called columns which are mounted in a non-rotary way within longitudinal grooves of the drum and are connected to the motor shaft of the feeder through a bearing and a rotary bush eccentric and sloping with respect to the shaft axis. When the latter rotates, the bush eccentricity and inclination cause on each column respectively a radial upward and downward movement and a longitudinal oscillation which, when combined, allow the column to lift the yarn windings from the drum surace, to advance them of one step and to lay them down again onto the drum surface. Said movement is performed in sequence by all columns, circularly to the drum, and the advancing step depends, eccentricity being equal, on the bush inclination with respect to the shaft.

This solution, though being valid, has the limitation of offering only a single value of the bush inclination and therefore a single value of the step between windings, which can be modified only by replacing the columns-bearingeccentric bush assembly with another one having an eccentric bush with a different inclination. It must be further notified that said inclination must be congruous with the direction of rotation of the motor shaft and when the latter changes it is practically necessary to replace the assembly.

Only said last replacement has been eliminated in the known technique (European patent application No. 0164033 published Dec. 11, 1985) by means of a bush in two pieces, which can be positioned at 180° to one another in order to vary the direction of inclination according to the direction of rotation of motor shaft, on its turn depending on the yarn twisting, S or Z.

Another type of solution (European Patent application No. 0131313 published Jan. 16, 1985) consists in taking advantage of the filling of an elastic hollow body inside the drum in order to always ensure the progress of the windings as a consequence of the variations in elasticity of said hollow body. However said solution has the drawback of not ensuring a wide range of configurations of the elastic body and therefore it is not suitable for all corresponding types of yarns.

OBJECTS OF THE INVENTION

The objects of the invention are to eliminate the aforementioned drawbacks of the presently used device, by providing an accumulating device for weft yarn feeders to textile machines, capable of advancing the weft yarn windings on the winding drum, keeping them spaced between each other of a predetermined step, and which allows to perform a modification of the step between the windings and/or an adjustement of the direction of rotation in a quick and precise way, without disassembling the whole feeder. Said device also ensures a uniform progress of the windings without discontinuity.

SUMMARY OF THE INVENTION

Said objects and further ones, which will better appear in the following specification, are achieved, according to this invention, by means of an accumulating device for weft yarn feeders to textile machines, of the type comprising a fixed drum on the external surface of which windings of weft yarn are positioned by positioning means rotated by a motor shaft, said drum having a series of longitudinal openings where fingers or columns fixed on a non rotating circular support are housed, said support being on its turn assembled, through a bearing, on an eccentric bush rotating with the motor shaft, characterized in that said eccentric bush is mounted on a floating joint: in that said joint and the bush are both rotationally connected to the motor shaft and in that control means are provided to vary and stop at will the inclination of the bush axis with respect to the motor axis.

DESCRIPTION OF THE PREFERRED EMBODIMENT

Figure 1:
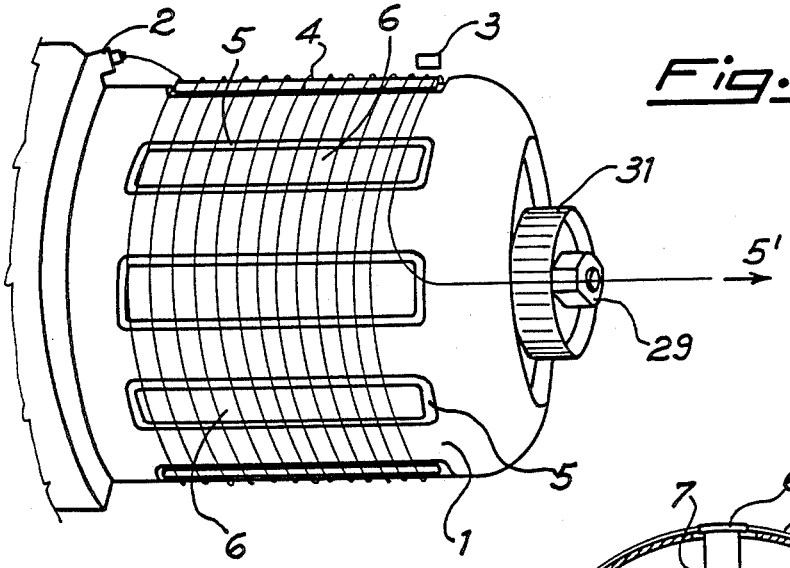
FIG. 1 is a perspective view of a drum for a weft yarn feeder according to the invention.

With reference to the drawings, an accumulating device for a weft yarn feeder essentially comprises a drum 1 mounted in a fixed overhanging way on a support (not illustrated), said drum 1 having a slightly cone-shaped side surface on which windings of yarn are placed by means of a known rotary positioning device schematically indicated by reference 2 in FIG. 1. A sensor device 3 detects whether windings are present or not in a certain section of the surface of drum 1 and, on the basis of that, it does or does not actuate feeding of other windings to the drum. The free end of the yarn 4 laying in winding on the drum is drawn as indicated by arrow 5' to be fed to a shuttleless loom, according to procedures well known to those skilled in this art.

The skirt surface of drum 1 is provided with a series of longitudinal openings 5, in each one of which one finger or "column" 6 moves, said column being positioned approximately parallel to the drum axis but variably movable and oscillating, within the opening, with respect to the skirt surface of the drum, in such a way to carry out an advancement of windings from their initial position, on the left of FIG. 1, towards the free end of the drum 1, always maintaining a predetermined step between the windings, and moreover taking into consideration the windings laying direction on the drum 1, which in turn depends on the treated yarn twisting.

Figure 2:
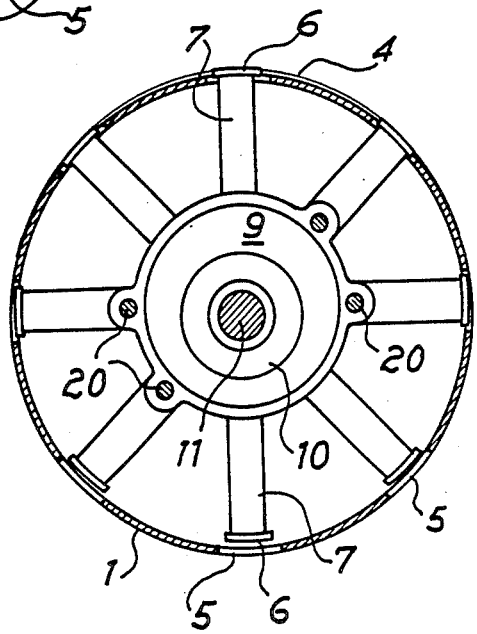
FIG. 2 is a schematic axial section of the drum of figure 1.

As shown in FIG. 2, each column 6 is supported by a support 7 radial with respect to the drum, all supports 7 being in turn connected to a ring support 8 which is mounted in a non rotary way on a bearing 9. This bearing houses a bush 10 assembled on an extension of the motor shaft 11 actuating the yarn positioning device.

According to the known technique, said movements of columns 6 are obtained by using a bush 10 which is at the same time eccentric and skew, namely mounted on shaft 11 in a way as to form a preset angle with the shaft axis.

In this way, eccentricity causes a radial displacement of each column 6 which cyclically projects over the drum skirt surface and lowers below the same. As it is obvious, when the column 6 projects over the skirt surface of drum 1, it collects the yarn windings 4 aligned on it and lifts them from the drum surface. In this condition, the column performs an oscillatory movement in an essentially longitudinal direction, which causes a longitudinal displacement of all the windings resting on it before said column lowers below the skirt surface of drum. The operation is performed in sequence by all columns, following the movement of the motor shaft 11 and therefore of the yarn positioning device.

Still according to the know technique, in case one wants to vary the step between said windings, it is necessary to remove the whole assembly comprising columns 6, supports 7, ring support 8, bearing 9 and bush 10, by replacing the same with another assembly having a bush 10 with an axis having a different inclination to the axis of shaft 11. Of course, it is a long-lasting and complex operation, because it requires the complete disassembling of drum 1. The same operation must be usually performed in case the direction of windings laid down by the device 2 has to be reversed to adapt itself to yarns having a different twisting. In this case, too, though it is possible to maintain, if desidered, the present winding step, it is usually necessary to replace the whole assembly because the bush 10 must have the same axis inclination, but in the opposite direction with respect to a neutral position.

Figure 4:
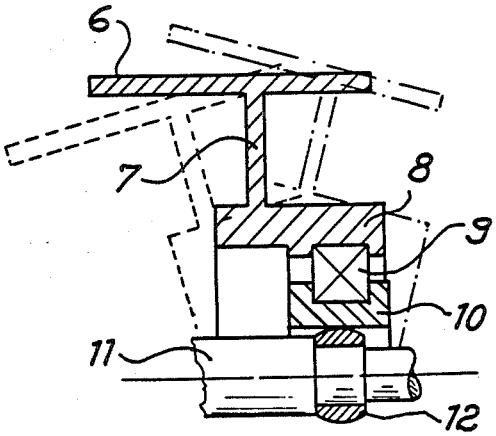
FIG. 4 is a schematic cross section illustrating the possibilities of adjusting a column.

The present invention solves the abovementioned problem by positioning between the bush 10 and shaft 11 a joint 12 (FIGS. 3 and 4), preferably a ball joint; by making both said joint 12 and bush 10 rotationally integral to the shaft 11; by adjusting the angular position of bush 10 as well as of bearing 9, support 8, standards 7 and column 6 taking advantage of the joint 12; and by holding said bush 10 in the preset adjustment position. In this way, it is also possible to obtain any desired inclination of the bush 10 with respect to the axis of shaft 11 and therefore any desired advancement step of the windings on the drum 1. It is also possible to perform said adjustments in both directions starting from a neutral position in which the angle formed by the axis of bush 10 with the axis of shaft 11 is zero, as said two axes coincide.

Figure 3:
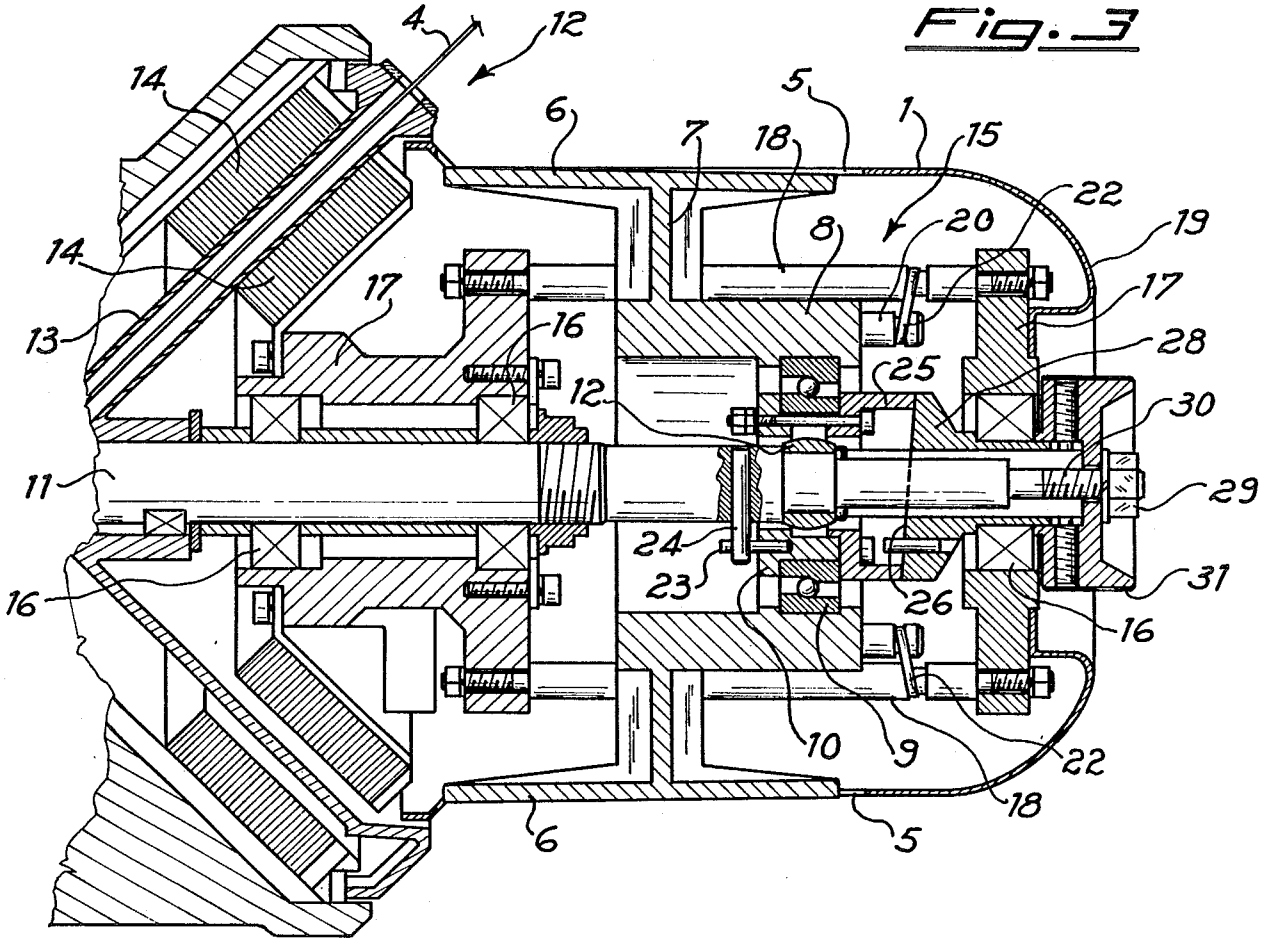
FIG. 3 shows a longitudinal section of the device according to the invention.

FIG. 3 shows in partial cross section an actual embodiment of the invention. The feeder 12 therein illustrated comprises a feeding device having a duct 13 in which the weft yarn 4 passes. The duct 13 is mounted in a rotary way on a motor shaft 11, which is actuated according to the above described procedures by a motor (not shown). By means of magnets 14, a supporting frame 15 is held overhanging, essentially extending parallel to the shaft 11 and connected to the latter through bearings 16 housed in supports 17, which are connected to each other by means of tension rods 18.

The side wall of drum 1 has slots 5 wherein columns 6 are housed, according to the previously described procedures, and placed on standards 7 which, in the shown example, are positioned at the top end of a ring support 8 mounted on a bearing 9, which is placed at the support bottom end, in such a way that each column 6 is supported by an element having an essentially L-shaped section, ending in correspondence to the bearing 9. The columns 6 are housed in the relevant openings 5 in a non rotary way, but freely floating both radially and longitudinally with respect to the shaft 11 and are therefore kept in said position by means of pivots 20 protruding from support 8 and housing resilient tension rods 22 placed between seats provided in said pivots 20 and seats provided in said tie rods 18 of the frame. In this way, the columns can perform the mentioned oscillation movements but they do not rotate with respect to the drum.

In order to perform said oscillation movements, the inner track of bearing 9 houses an eccentric bush 10 which in turn is mounted on a ball joint 12, fixed for instance by shrinking on the axis 11. The eccentric bush 10, as well, is fixed in order to rotate together with the shaft 11 and for this purpose it is provided with two pivots 23 projecting in a direction parallel to axis 11, between which a third pivot 24 fixed to the shaft is inserted, the play between said two pivots 23 and pivot 24 being such as to allow the necessary inclination movements permitting the desired positioning of bush 10 and that connected thereto (bearing 9, support 8, standards 7, columns 6) with respect to the axis of shaft 11, in order to vary, as before said, the step between the windings advanced on drum 1. In order to obtain said positioning control, the bush 10 is fixed to a cam follower 25 having a surface 26 sloping by an angle alpha with respect to a plane perpendicular to the axis of shaft 11, said surface 26 coinciding with that of a cam 28 placed in a rotary way with respect to the frame 15, being assembled in correspondence of the last bearing 16. In this way, the cam 28 and cam follower normally rotate, during the yarn positioning, together with the bush 10 and shaft 11, being fixed to the latter for example by means of a nut 29 tightened on the threaded end 30 of shaft 11 and acting on a knurled handle 31 directly connected to said cam 28. In case it is wanted to modify the inclination of bush 10 with respect to the axis of shaft 11, it will be sufficient to unscrew the nut 29, thus allowing the cam 28 and handle 31 to rotate with respect to the axis of shaft 11. Under these conditions, the motor shaft 11 is manually held, for instance through the yarn positioning device, and the handle 31 is rotated until it reaches a desired adjustment, in one direction or in the other one with respect to a zero position (coincidence of the axes of bush 10 and shaft 11), according to the direction of rotation of the motor shaft 11. This adjustment could be performed with the help of notches which will indicate the different chosen positions, possibly even giving the step between the windings. Once the bush inclination has been adjusted on the desired value, it will be sufficient to fix again the whole assembly by screwing the nut 29 to be ready to work again. This adjustment operation is extremely quick and easy and avoids the present need of disassembling the whole unit as well as the need of having in stock a number of bushes with different inclinations.

I claim:

1. An accumulating device for weft yarn feeders to textile machines comprising fixed drum means having an external surface on which windings of said weft yarn are positioned, said external surface of said fixed drum means including a plurality of longitudinally extending openings, rotatable motor shaft means having a longitudinal axis within said fixed drum means, floating joint means fixed to said rotatable shaft means for rotation therewith, eccentric bush means affixed to said rotatable shaft means for rotation therewith, said eccentric bush means being mounted on said floating joint means and being angularly positionable on said floating joint means with respect to said longitudinal axis of said rotatable shaft means, yarn winding adjustment means comprising a plurality of finger members corresponding to said plurality of longitudinally extending openings in said fixed drum means, a plurality of support members supporting said plurality of finger members, and ring support means mounting said plurality of support members, bearing means for mounting said yarn winding adjustment means on said eccentric bush means, and control means for angularly positioning said eccentric bush means with respect to said longitudinal axis of said rotatable shaft means, whereby said angular positioning of said eccentric bush means results in corresponding angular positioning of said plurality of finger members with respect to said external surface of said fixed drum means.

2. The device according to claim 1, wherein the control means comprises at least a cam surface inclined with respect to the axis of motor shaft and angularly adjustable by rotation around the same axis, in both directions starting from a neutral position, as well as a cam follower fixed to said eccentric bush, said cam and cam follower rotating with the motor shaft during the yarn positioning.

3. The device according to claim 2, wherein the cam follower consists of a second surface coinciding with and coupled in a sliding way to said cam surface.

4. The device according to claim 1, wherein the bush is rotationally coupled to said motor shaft by means of at least a pivot and at least a related seat, between pivot and seat a sufficient play existing as to allow said bush inclination by adjustment movements, maintaining the rotary coupling.

5. The device according to claim 1, wherein a center plane of said bush is offset with respect to a center plane of the ring support means.

6. The device according to claim 1, wherein the ring support means is connected to a non-rotary part of the drum through elastic tie rods.

* * * * *